United States Patent [19]

Weis

[11] Patent Number: 4,594,153

[45] Date of Patent: Jun. 10, 1986

[54] SEWAGE PUMPING STATION

[75] Inventor: Frank G. Weis, Kansas City, Mo.

[73] Assignee: Smith & Loveless, Inc., Lenexa, Kans.

[21] Appl. No.: 704,075

[22] Filed: Feb. 21, 1985

[51] Int. Cl.[4] ..... C02F 1/00

[52] U.S. Cl. ..... 210/104; 210/170; 210/171; 210/258

[58] Field of Search ..... 210/104, 170, 171, 258, 210/921, 926

[56] References Cited

U.S. PATENT DOCUMENTS

| | | | |
|---|---|---|---|
| 3,114,384 | 12/1963 | Quase . | |
| 3,448,885 | 6/1969 | Parks . | |
| 3,497,062 | 2/1970 | Carlani, Jr. . | |
| 3,607,735 | 9/1971 | Hover . | |
| 3,653,343 | 1/1972 | Holland | 210/104 |
| 3,746,173 | 7/1973 | Daniel | 210/258 |
| 3,875,051 | 4/1975 | Kovarik . | |
| 3,948,408 | 4/1976 | Trout et al. . | |
| 4,145,287 | 3/1979 | Walker et al. | 210/104 |
| 4,193,873 | 3/1980 | Thrasher . | |
| 4,305,818 | 12/1981 | Tillinen et al. | 210/170 |
| 4,424,125 | 1/1984 | Martin | 210/104 |

OTHER PUBLICATIONS

Smith & Loveless, Inc. Bulletin #603KB entitled "*Custom Series Pump Stations*".

Smith & Loveless, Inc. Drawing No. 28D986 entitled "7'-0 *DIA Duplex Sewage Lift Station*", 2/1980.

Smith & Loveless, Inc. Drawing No. 28D998 entitled *Factory Built "Capsular" Pumping Station* 8'-0"×21'-0" 11/1982.

*Primary Examiner*—John Adee

*Attorney, Agent, or Firm*—Dressler, Goldsmith, Shore, Sutker & Milnamow, Ltd.

[57] ABSTRACT

A sewage pumping station is disclosed which includes a sewage receiving wet well positioned adjacent to a machinery chamber which contains sewage pump means and associated controls. A base beam means, of hollow rectangular cross-section, is secured to the underside of the floor of the machinery chamber. The base beam means defines a suction pipe extension conduit in fluid communication with the wet well. Sewage pump means are supported above the floor of the machinery chamber by a substantially vertical suction conduit extending therebetween. The lower end of the suction conduit is in fluid communication with the suction extension conduit.

A sump pump assembly is provided within the machinery chamber which directs accummulated liquid into the suction extension conduit. A control assembly is provided within the machinery chamber which senses the pressure within the suction extension conduit and controls the operation of the sewage pump means dependent upon the liquid level in the wet well.

9 Claims, 5 Drawing Figures

SEWAGE PUMPING STATION

FIELD OF THE INVENTION

This invention relates to sewage pumping stations and more particularly to sewage pumping stations of the type for lifting sewage from a sewage receiving wet well positioned adjacent to the station.

BACKGROUND OF THE INVENTION

Sewage pumping or lift stations are typically part of a wastewater treatment system of a municipality. The pumping station is provided where the terrain requires that the wastewater be piped from lower to higher elevations. Sewage pumping stations typically include two basic components; namely a sewage receiving or collecting chamber, commonly referred to as a "wet well", and a chamber or housing containing the pumps and associated control equipment for lifting the sewage collected in the wet well to a higher elevation, commonly referred to as a "machinery chamber".

Over the years many different types and designs of sewage pumping stations have been developed in the sewage pumping art to lift or transfer sewage wastewater and other types of industrial wastewaters. The art has designated the different types of sewage pumping stations into the "wet pit" type and the "dry pit" type. The wet pit type includes pumping stations in which the pumps are positioned within the wet well below the liquid sewage level. The dry pit type includes those stations in which the pumps are positioned outside of the wet well and not submerged in the liquid sewage. The present invention is directed to an improved dry pit type of pumping station.

There are many different types of dry pit type pumping stations. For example, there are buried pumping stations, above-grade pumping stations, wet well mounted pumping stations and recessed wet well mounted pumping stations. The buried pumping stations and the above-grade pumping stations typically include a sewage receiving wet well positioned adjacent to a machinery chamber. The wet well mounted pump stations and the recessed wet well mounted pump stations typically include a machinery chamber mounted above a sewage receiving wet well. The present invention is directed to the buried and above-grade types of pumping stations and most particularly to the buried type of pumping station having a factory built steel machinery chamber.

Buried type pumping stations generally include a buried sewage receiving wet well, typically of cylindrical concrete construction, and a buried machinery chamber which contains the pumps and associated control equipment. The machinery chamber may be of field erected concrete construction or of factory built steel construction, the latter being more economical to manufacture and install and therefore generally preferred. The machinery chamber is typically defined by a substantially flat floor and an upstanding sidewall extending upwardly therefrom. The floor of the machinery chamber is typically reinforced by a plurality of base beams secured to the undersurface thereof. At least one sewage pump means is positioned above the floor within the machinery chamber. The sewage pump means includes a base member above which is mounted the pump volute and the pump motor. A suction pipe extends vertically downwardly from the volute through the base member and extends horizontally across the floor and out the sidewall of the machinery chamber into a lower portion of the wet well. A discharge pipe extends horizontally outwardly from the volute and through the sidewall of the machinery chamber. The sewage from the wet well is pumped from the wet well through the suction pipe into the volute and then through the discharge pipe out of the pumping station.

In order to control the operation of the sewage pump means dependent upon the liquid level in the wet well, an air bubbler system is typically utilized. Such systems typically include air lines, air compressors and air rate controls. The air lines extend from the machinery chamber into the wet well, passing through the respective sidewalls thereof. It is also well known in the art to utilize displacement swithces suspended by wires in the wet well, which wires extend from the wet well into the machinery chamber. Further, it has heretofore been proposed to utilize pressure switch arrangements which communicate with a section of the suction line within the machinery. An example of such an arrangement is disclosed in U.S. Pat. No. 3,842,224, assigned to the same assignee as the present invention. A sump pump is typically provided in a sump well, formed in the floor of the machinery chamber, containing a sump pump to lift liquid collected therein through a discharge line extending from the machinery chamber into the wet well.

The pumping stations of the designs described hereinabove have served the industry quite well over the years. However, there have been various problems associated with the operation, construction and maintenance of these pumping stations, to which the present invention is intended to overcome.

There have been problems associated with the connection between the sewage receiving wet well and the sewage pump means. As indicated above, this connection is typically accomplished by utilizing a suction pipe made from standard piping, usually of larger size than the designated pump size if the flow rate is high. This presents the problem of how to seal the suction pipe to the sidewalls of the machinery chamber to prevent infiltration of ground water into the machinery chamber in buried stations and the natural elements in above ground stations. In a preferred construction where the wet well and the machinery chamber are supported on a common slab or support, it has heretofore been necessary to provide a special bottom construction in the wet well to raise the bottom thereof to approximately the height of suction pipe or to somehow convey the suction pipe down to the level of the floor of the wet well. The present invention solves these problems without special construction.

There have also been problems associated with the fact that the suction pipes lay across the floor in the machinery chamber and require the use of ell pipe sections and special fittings and other pipe sections, all of which take up valuable floor space in the machinery chamber. The suction piping inside the machinery chamber must be blasted or otherwise cleaned and painted to resist corrosion. Further, the suction piping must be installed in such a manner as to prevent piping strains on the pumps which are mounted on separate rigid bases, which bases must be leveled to prevent piping strains. The bases are fabricated parts that require cleaning, painting, careful layout and masking of the mounting bolts. This is also a source of resonant frequency vibration problems. The present invention solves these suction pipe problems and utilizes standard pipe fittings.

There have further been problems associated with the requirement that the control panel be positioned over the tops of the operators of the discharge valves associated with the discharge pipe. The necessity of the bases beneath the pumps for the piping requirements as discussed above, places these discharge valves in a relatively high position in the machinery chamber, requiring an even higher control panel mounting, thereby resulting in a greater machinery station height and sometimes less accessible switches. The present invention solves these problems by eliminating the necessity of mounting the pump on support bases.

There have been problems associated with the necessity of having external connections between the sump pump discharge line and controls associated with the sewage pumps and the wet well. These connections typically have to be made by the contractor. The present invention eliminates these external connections, and in so doing, faciliates the operation of the station by positioning all the equipment in close proximity to the control panel.

Further it has heretofore been difficult to test the operation of the entire pumping station and piping without the machinery chamber shell in place. It was necessary to remove and add piping during such testing, and after completion of the testing, the piping must be reinstalled to the shell. Further, it was not possible to test the pump control switches and sump pump as it will operate in the field. The present invention solves these problems by permitting the testing of the entire pumping station without the machinery chamber shell in place and without the necessity of removing and adding piping.

SUMMARY OF THE INVENTION

A preferred embodiment of a sewage pumping station, constructed in accordance with the present invention, includes a sewage receiving wet well that is positioned adjacent to a machinery chamber which houses the pumps and associated controls. The wet well and the machinery chamber are preferably supported on a common concrete slab. The wet well is typically of cylindrical shape having inclined sidewalls formed therein adjacent the lower portion thereof to facilitate the withdrawal of sewage therefrom.

The machinery chamber is defined by a flat floor and a peripheral sidewall extending upwardly therefrom. A roof and a suitable entrance manway close off the top of the machinery chamber. The floor of the machinery chamber is supported on base beam means, preferably having a hollow rectangular cross section, the upper surface of which is secured to the underside of the floor. The base beam means defines a suction pipe extension conduit having an open first end, which extends into a lower portion of the wet well, and a closed second end.

The sewage pump means is positioned within the machinery chamber above the floor. The sewage pump means includes an inline mounted pump having a motor assembly and a volute assembly. The pump is supported above the floor by a suction conduit having an upper end mounted to the volute and a lower end secured to the floor. The lower end of the suction conduit is positioned above an intermediate section of the suction extension conduit and is in fluid communication therewith through an opening formed in the floor. The suction pipe acts as the base of the pump eliminating the normal support base. The suction extension conduit preferably inclines downwardly from its open end towards its closed end to permit entrained air entering therein while the pumps are off to rise and return to the wet well. Thus, the base beam serves the dual function of reinforcing the floor of the machinery chamber and acting as part of the suction conduit between the wet well and the sewage pump means.

A sump well is formed in the floor of the machinery chamber and contains a sump pump. The discharge from the sump pump is directed through a discharge conduit which extends through an opening in the floor and into the suction extension conduit. The control means for controlling the operation of the sewage pump means is contained within the machinery chamber. The control means includes a pressure transducer means, in fluid communication with the suction extension conduit to sense the liquid level in the wet well, and a pressure switch means in communication with the pressure transducer means to control the operation of the sewage pump means.

Other advantages and features of the invention will be apparent from the specification, drawings and claims as herein set forth.

DESCRIPTION OF PREFERRED EMBODIMENTS

Figure 1:
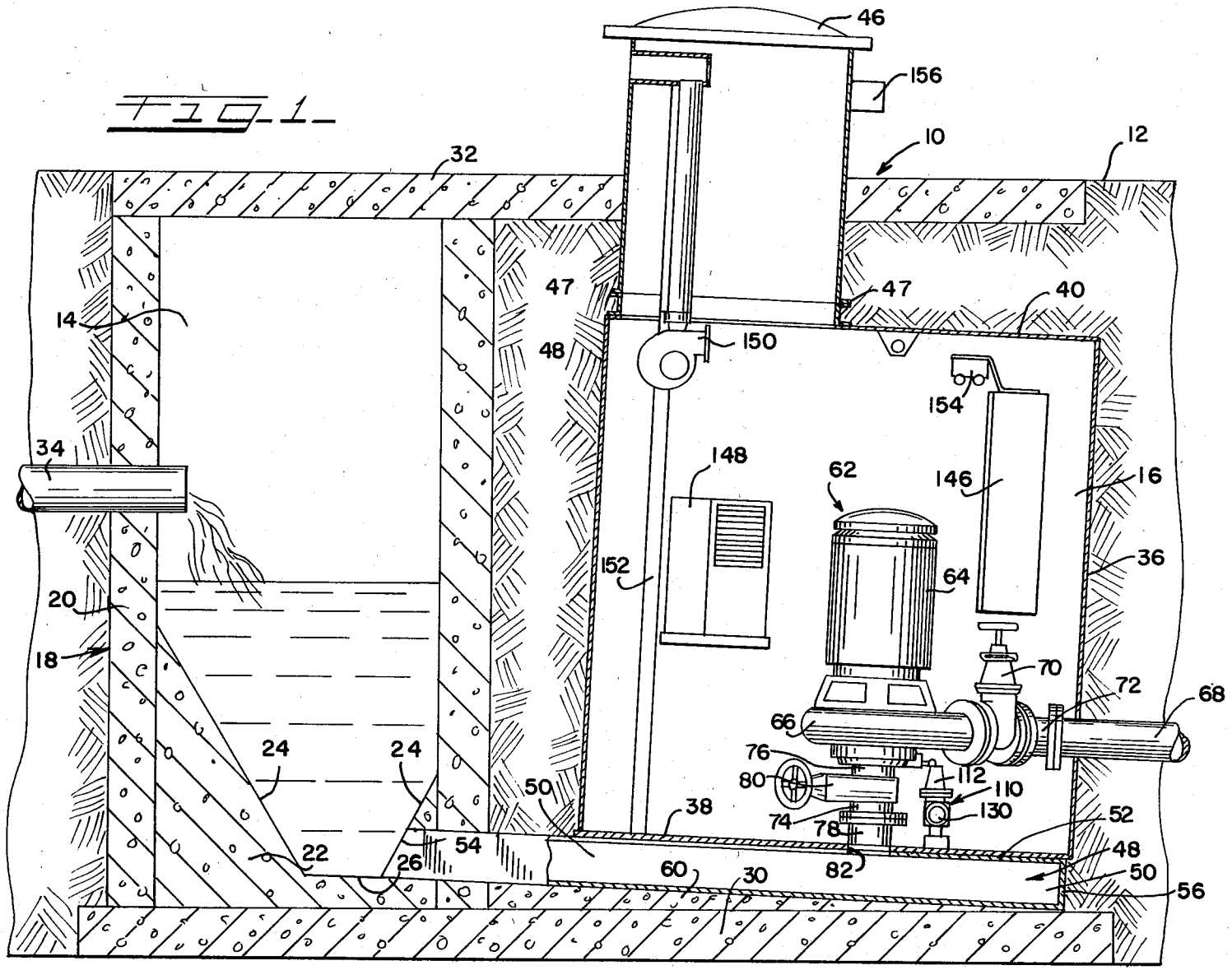
FIG. 1 is an elevation view, partially in cross-section, of a preferred embodiment of a sewage pumping station constructed in accordance with the present invention.
Figure 2:
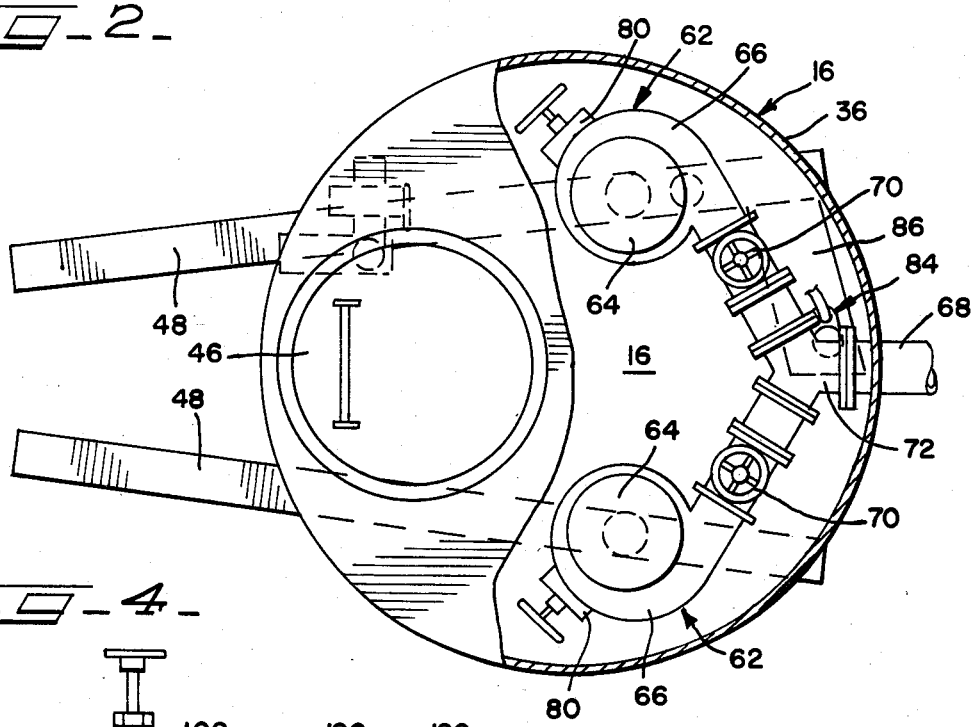
FIG. 2 is a top plan view, partially broken away, of the machinery chamber of the sewage pumping station illustrated in FIG. 1.
Figure 3:
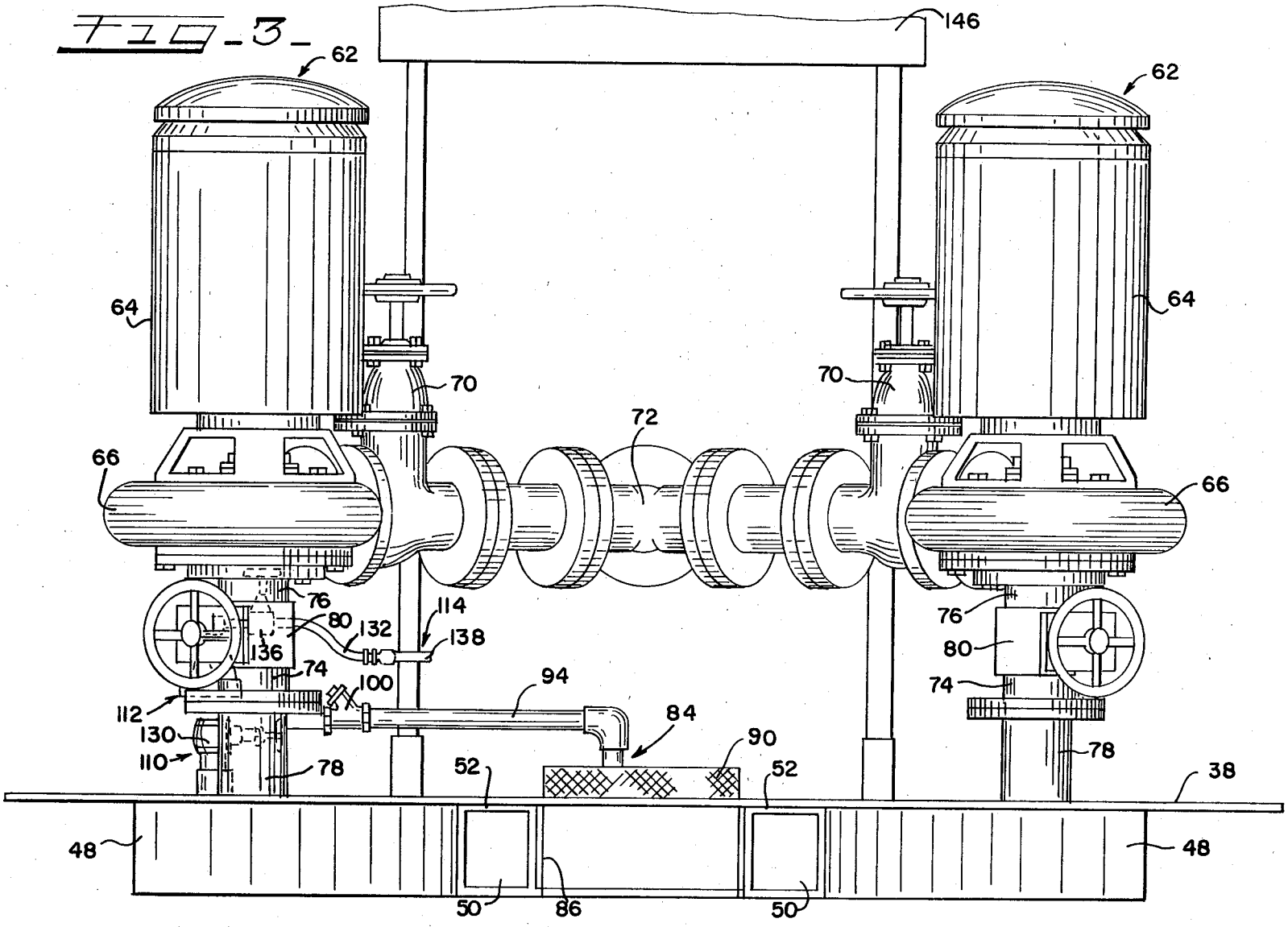
FIG. 3 is an enlarged elevation view of the sewage pump means as mounted within the machinery chamber of the sewage pumping station illustrated in FIGS. 1–2.

Referring to FIGS. 1–3, a sewage pumping station 10 is illustrated as constructed in accordance with a preferred embodiment of the invention. As best seen in FIG. 1, station 10 is a buried type of pumping station wherein the ground level is indicated by the reference numeral 12. However, as one skilled in the art will appreciate, although the station is typically installed below the ground level, the station 10 may be installed partially or completely above the ground level, with little or no modifications thereto.

Station 10 comprises a sewage receiving wet well 14 and a machinery chamber 16. Wet well 14 may be of any well known construction of either concrete, steel, or the like. Typically wet well 14 is constructed from a section of a cylindrical concrete pipe 18 so as to define sidewalls 20. The bottom of wet well 14 is typically formed with grout 22 to define sloping side surfaces 24, which extend downwardly and inwardly towards the bottom of wet well 14, and a bottom surface 26. The lower edges of concrete pipe 18 are typically supported on a substantially horizontal concrete slab 30. The upper edges of concrete pipe 18 are typically closed off by a concrete slab 32 having a suitable manway opening formed therein (not shown). A wet well inlet pipe 34 extends through an intermediate section of sidewall 20 for directing sewage wastewater into wet well 14. The wet well 14 as described above is of well known construction.

Machinery chamber 16 is positioned adjacent to wet well 14 and is defined by an upstanding sidewall 36, a floor 38 and a roof 40. Sidewall 36 is typically of circular cross-section, however, it may be rectangular, abround, or the like, in cross-section. The lower edges of sidewall 36 are secured to floor 38 and the upper edges of sidewall 36 are secured to roof 40. As is well known in the art, an entrance manway 42 extends upwardly from roof 40 above ground level 12. Manway 42 is in communication with the interior of machinery chamber 16 through an opening 48 formed in roof 40 and is provided with a suitable cover member 46 to selectively close off the top thereof. Suitable beams 47 are typically provided to reinforce roof 40. In accordance with the preferred embodiment, sidewall 36, floor 38 and roof 40 are fabricated of steel, however, the present invention contemplates the use of other materials such as concrete, fiberglass, or the like.

The disclosure which hereinbelow follows describes a pumping station which contains two sewage pumps. However, the present invention is contemplated for use in conjunction with pumping stations containing any number of sewage pumps with obvious modifications thereto.

In accordance with one of the features of the present invention, a pair of base beams 48 are provided immediately under floor 38. Base beams 48 are of hollow construction so as to define a suction extension conduit 50. In accordance with the preferred embodiment, base beams 48 are of rectangular cross-section having an upper surface 52 which is secured to the underside of floor 38. However, it is contemplated that the cross-section of base beams 48 may be of other structural shapes, i.e., trapezoidal, octagonal, or the like. It is preferred that base beams 48 have lower and upper surfaces which respectively lay on the concrete slab 30 and conform to the undersurface of floor 38. The base beams 48 are of sufficient modulus to reinforce the floor 38 so that the hydrostatic pressure from ground water and other loads applied to the floor will not cause the flat floor to buckle. The dimensions of extension conduits 50 are selected to give the necessary liquid velocity dictated by the station design capacity. The liquid velocity should be high enough to carry solids and low enough to keep hydraulic surge on pump start and stop to a minimum. Preferably the velocity of liquid flow though extension conduits 50 should be in the range of 0.5 to 5.0 feet per second. The fact that the extension conduits 50 are rectangular also helps prevent vortexing in the wet well 14 and pre-rotation in the inlet to the sewage pumps.

Base beams 48 have an open first end 54 and a closed second end 56. As best seen in FIG. 1, the open ends 54 extend through lower sections of sidewall 20 into wet well 14 in fluid communication with the sewage wastewater contained therein. The outer edges of open ends 54 are preferably beveled to conform with sloped surface 24. For reasons which will hereinbelow become more apparent, base beams 48 are slightly inclined downwardly from their open ends towards their closed ends. Similarly, the machinery chamber 16 supported thereon is slightly inclined. The area between the lower surfaces of base beams 48 and concrete slab 30 are preferably filled with grout 60 to rigidly support the base beams above the slab.

Machinery chamber 16 contains two sewage pump means 62 supported therein above floor 38. Sewage pump means 62 are of well known construction, an example of which is described in U.S. Pat. No. 3,519,369, assigned to the same assignee as the present invention. Sewage pumping means 62 include motor assemblies 64 and volute assemblies 66. Extending radially outward from volute assemblies 66 are discharge conduits 68 which are provided with suitable gate valves 70. Discharge conduits 68 are joined together by a wye fitting 72 within machinery chamber 16 and extend outwardly from machinery chamber 16 as a single discharge conduit 68.

In accordance with another feature of the invention, the sewage pump means 62 are supported within machinery chamber 16 above floor 38 by suction conduits 74, eliminating the necessity of separate base members. Suction conduits 74 have upper end sections 76 suitably secured to the underside of volute assembly 66, and in fluid communication with the interior thereof, and lower end sections 78 suitably secured to floor 38. Gate valves 80 are preferably provided between sections 76 and 78. Lower end sections 78 extend through aligned openings 82 in floor 38 and base beams 48 such that they are in fluid communication with corresponding suction extension conduits 50. As will hereinbelow become more apparent, suction conduits 74 serve the dual function of acting as the suction pipe for the sewage pump means 62 and act as the support base for the sewage pump means.

As best seen in FIG. 2, the base beams 48 are oriented to align with the suction conduits 74 and to facilitate passage of the open ends 54 thereof into wet well 14. In the embodiment illustrated in FIGS. 1-3, the base beams 48 converge towards each other as they extend towards wet well 14. However, it is anticipated that, in alternative embodiments, the base beams 48 may be parallel to each other or diverge away from each other.

Figure 4:
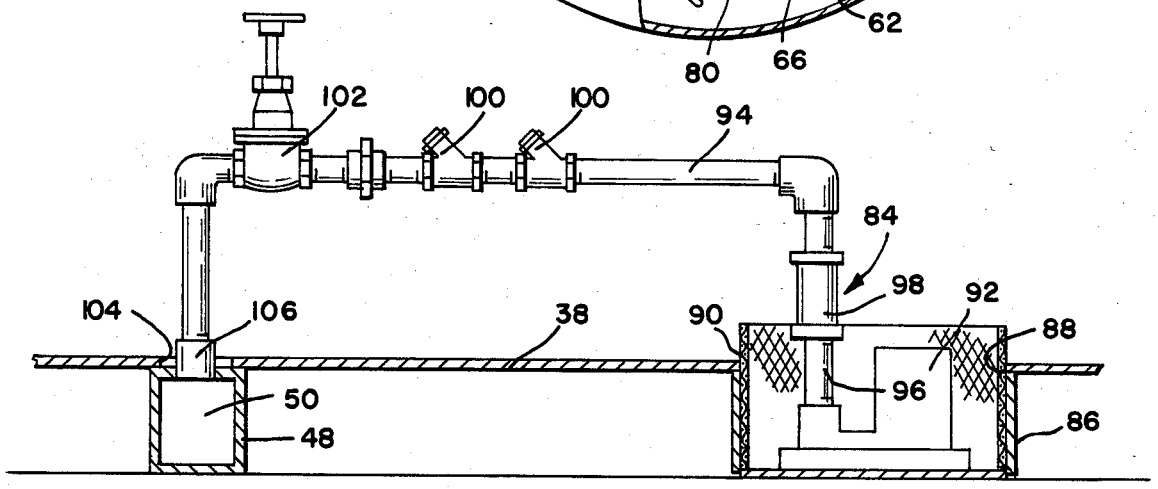
FIG. 4 is an elevation view, partially in cross-section, of the sump pump assembly of the sewage pumping station illustrated in FIGS. 1–3.

Referring to FIGS. 2-4, pump station 10 is provided with a sump pump assembly 84 for withdrawing liquid which would otherwise tend to accumulate on the floor 38 within machinery chamber 16. The sump pump well 86 extends downwardly from floor 38 in communication with an opening 88 formed therein. The sump pump well 86 is preferably positioned at an area in floor 38 having the lowest elevation so that liquid on floor 38 flows thereinto. A screen 90 extends above the upper surface of floor 38 to prevent solid matter which might clog the sump pump from entering sump well 86. A conventional sump pump 92 is positioned within sump well 86. A sump pump discharge conduit 94 is connected at its inlet end to the discharge pipe 96 of sump pump 92 through a flexible coupling 98. Discharge conduit 94 is typically provided with a pair of check valves 100 and a gate valve 102. The outlet end of discharge conduit 94 extends through an opening 104 in floor 38 in fluid communication with suction extension conduit 50 through a coupling 106. It is therefore no longer necessary to run the discharge conduit 94 from the machinery chamber 16 to the wet well 14.

Figure 5:
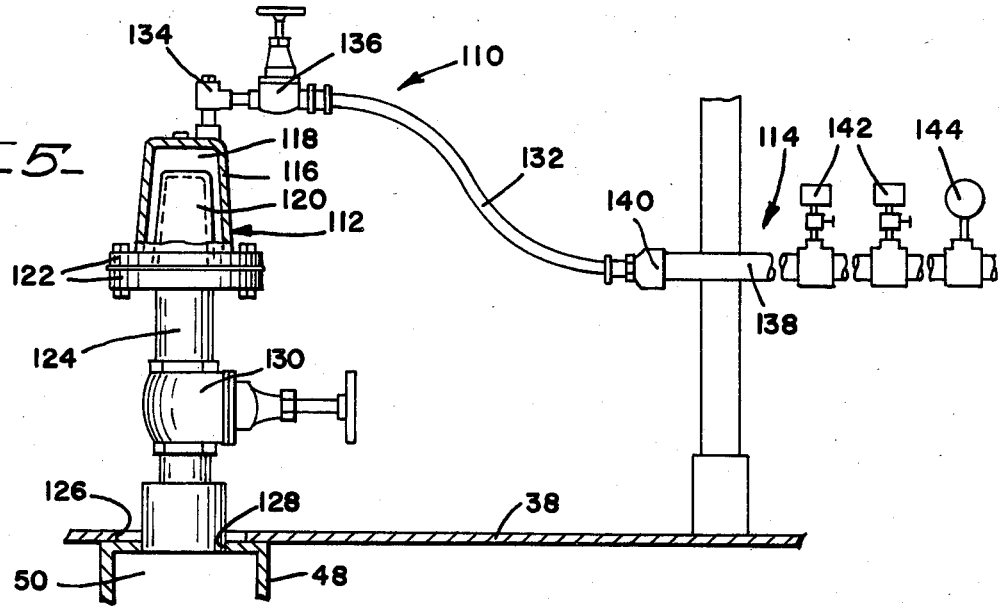
FIG. 5 is a elevation view, partially in cross-section, of the sewage pump control means of the sewage pumping station illustrated in FIGS. 1–3.

Referring to FIGS. 1, 3 and 5, a control assembly 110 is provided within machinery chamber 16 to control the operation of the sewage pump means 62 dependent upon the liquid level in wet well 14. In accordance with a preferred embodiment of the invention, control assembly 110 includes a pressure transducer assembly 112, in fluid comunication with the liquid in suction extension conduit 50, for sensing the pressure therein and a pressure switch assembly 114 responsive to pressure transducer assembly 112. Referring specifically to FIG. 5, pressure transducer assembly 112 includes an inverted cup-shaped housing 116 defining a chamber 118. A flexible rubber bladder 120 is provided in closing relationship to chamber 118 and extends thereinto, as shown in FIG. 5. Bladder 120 is suitably retained in place between mounting flanges 122. Extending downwardly from mounting flanges 122 is a pipe 124, which has an upper end in fluid communication with bladder 120 and a lower end which extends through an opening 126 in floor 38 into fluid communication with suction extension conduit 50 through an opening 128 formed in base beam 48. A gate valve 130 is preferably provided in an intermediate section of pipe 124. Extending from an upper section of housing 116 is a flexible tube 132 having a first end in fluid communication with chamber 118 through suitable fittings 134 and a second end in fluid communication with pressure switch assembly 114. A gate valve 136 is preferably provided in an intermediate section of tube 132.

Pressure switch assembly 114 includes a pipe 138 suitably secured at one end to tube 132, and in fluid communication therewith, through connector 140, and closed off at its other end. Pump control pressure sensitive switches 142 and a pressure gauge 144 are tapped into pipe 138, in fluid communication therewith. Pressure switches 142 are suitably wired to a station control panel 146 contained within the machinery chamber. Chamber 118, tube 132 and pipe 138 are filled with a liquid such as light weight oil, glycerine, or the like. A seen in FIG. 1, control assembly 110, sump pump assembly 84, the various valves associated with the sewage pump means 62 and the control panel 146 are preferably located in close proximity to each other to facilitate wiring and operation of the station.

As is conventional in most sewage pumping stations, a dehumidifier assembly 148, a ventilation blower assembly 150, a ladder 152 and a light 154 are provided within machinery chamber 16, all of which are of well known construction and operation. Similarly, a suitable vent outlet 156 is provided through entrance manway 42.

From the brief discussion of the operation of sewage pumping station 10 which hereinbelow follows, the unique cooperation of the various components of the station as described above will become more apparent.

Sewage wastewater enters wet well 14 through inlet pipe 34. The liquid sewage from wet well 14 enters and fills suction extension conduit 50, suction conduit 74 and pipe 124. As the level of liquid level in wet well 14 rises, the pressure within suction extension conduit 50 and pipe 124 increases forcing bladder 120 to stretch and thereby displace the liquid within chamber 118 of pressure transducer assembly 112 into tubing 132. The displaced liquid increases the liquid pressure within tubing 132, and when such pressure reaches a predetermined value or values, one or both of the pressure switches 142 are activated. The liquid pressure may be monitored by pressure gauge 144. In a manner well known in the art, pressure switches 142 may cooperate with circuitry in control panel 146 to start either one or both of the sewage pump means 62. The pressure switches 142 are activated at different preset values, thereby controlling whether one or both of the sewage pump means 62 are started.

The sewage pump means 62 withdraws liquid sewage from wet well 14 through suction extension conduit 50 and suction conduit 74 into volute assembly 66 and then through discharge pipe 68 in a conventional well known manner. As the liquid level in wet well 14 decreases, the pressure within suction extension pipe 50 and pipe 124 likewise decreases, thereby permitting bladder 120 to return to its original shape and reduce the pressure in tubing 132. When the pressure within tubing 132 returns to a predetermined minimum value or values, one or both of the switches 142 are inactivated and the circuitry in control panel 146 shuts off one or both of the sewage pumping means 62. Thus, the sewage pump means 62 are directly controlled dependent upon the pressure in extension conduit 50, which in turn is directly dependent upon the liquid level in wet well 14.

Should any liquid accummulate on floor 38 within machinery chamber 14, such liquid is directed into sump well 86 and pumped therefrom by sump pump 92 through discharge pipe 94 into suction extension conduit 50. The sump pump assembly 84 is contained internally within machinery chamber 16, and does not require any external connections.

As described hereinabove, the base beams 48 are inclined downwardly from their open ends to their closed ends. This is significant in two respects. Firstly, any entrained air entering the extension suction conduit while the sewage pump means are shut off, will rise and be returned to wet well 14. This prevents air bubbles from entering the sewage pumping means and causing them to air lock. Secondly, raising the inlet ends of the base beams above the slab 30, permits grouting the open ends of the base beams all around where they enter the sidewall 20, thus making a water tight seal. It is also significant to note that, slab 30 and grouting 60 provide a firm support for base beams 48 and thereby eliminates suction line breakage which occassionally occurred in the prior sewage stations as a result of earth settling under the elevated suction pipes.

As alluded to hereinabove, the suction conduits 74 serve as the support bases of the sewage pump means 62, eliminating the necessity of separate rigid base members to elevate the sewage pump means. The design of suction conduits 74 in cooperation with suction extension conduits 50, reduces the overall height of the machinery chamber and eliminates the necessity of complex suction piping arrangements which take up valuable floor space and increase the cost of the station. Further, the elimination of the support bases for the sewage pump means results in the elimination of one of the three normal rigid attachment points of the sewage pump means. The only remaining points of rigid attachment are the suction conduit 74 and the discharge conduit 68. This permits the suction conduit 74 to be secured in place after the discharge conduit 68 has been suitably connected, thereby reducing piping strain and resultant cause of vibration of the sewage pump means. Also, the cooperation of suction conduit 74 and suction extension conduit 50 eliminates the necessity of the placement of discharge conduit 68 where standard pipe fittings dictate and thereby permits the discharge conduit to be positioned in a manner which maximizes space utilization.

The sewage pumping station of the present invention facilitates testing of the entire station and associated piping with the suction line in place without the machinery chamber shell in place. The specific arrangement and construction of suction conduit 74, suction extension conduit 50, the sump assembly 84, and pump control assembly 110 in accordance with the invention allows all the piping and auxilliary equipment to be tested at the factory as it will operate in actual field installation.

While the preferred embodiment described herein is at present considered to be preferred, it is understood that various modifications and improvements may be made therein, and it is intended to cover in the appended claims all such modifications and improvements as fall within the true spirit and scope of the invention.

What is claimed is:

1. A sewage pumping station for pumping sewage from a sewage receiving wet well positioned adjacent thereto, said sewage pumping station comprising:

(a) a machinery chamber defined by a floor and a sidewall extending upwardly from said floor;

(b) said machinery chamber containing sewage pump means supported above said floor;

(c) base beam means positioned immediately below and secured to said floor of sufficient modulus to reinforce said floor against buckling, said base beam means being of hollow construction so as to define a suction extension conduit having an open first end which extends into and is in fluid communication with a lower portion of said wet well and a closed second end; and (d) suction conduit means extending between said sewage pump means and said floor, said suction conduit having an upper end in fluid communication with said sewage pump means and a lower end in fluid communication with said suction extension conduit through an opening formed in said floor.

2. The invention as defined in claim 1 wherein said floor is substantially flat and said base beam means is of rectangular cross-section.

3. The invention as defined in claim 2 wherein said base beam means is inclined downwardly from its open end towards its closed end.

4. The invention as defined in claim 1 wherein said machinery chamber contains a plurality of sewage pump means and corresponding suction conduit means above said floor and wherein said base beam means is in fluid communication with each of said suction conduit means.

5. The invention as defined in claim 1 including a sump pump means positioned in a sump well formed in said floor, said sump pump means having a discharge conduit for directing liquid from said sump well into said suction extension conduit.

6. The invention as defined in claim 1 further comprising control means contained within said machinery chamber for controlling the operation of said sewage pumping means dependent upon the liquid level in said wet well, said control means including pressure transducer means in fluid communication with said suction extension conduit for sensing the pressure in said suction extension conduit through an opening in said floor and pressure switch means in communication with said pressure transducer means.

7. The invention as defined in claim 1 wherein the lower portion of said wet well has a sloping sidewall and the outer edge of said open first end of said base beam means is beveled to be in a common plane with said sloping sidewall.

8. The invention as defined in claim 1 wherein said machinery chamber includes a roof in covering relationship with said sidewall and an entrance manway extending upwardly from said roof in communication with said machinery chamber through an opening in said roof.

9. The invention as defined in claim 1 wherein said sewage pump means includes a volute assembly and said suction conduit has an upper end secured to said volute assembly and a lower end secured to said floor so as to support said sewage pumping means above said floor.

* * * * *